US006305099B1

(12) United States Patent
Chu

(10) Patent No.: US 6,305,099 B1
(45) Date of Patent: Oct. 23, 2001

(54) SHOE WITH AIR VALVE FOR AIR REFRESHING SYSTEM

(76) Inventor: Huey-Cheng Chu, 42, Sec, 1. Huanho S., Rd., Taipei (TW)

( * ) Notice: Subject to any disclaimer, the term of this patent is extended or adjusted under 35 U.S.C. 154(b) by 0 days.

(21) Appl. No.: 09/551,526

(22) Filed: Apr. 18, 2000

(30) Foreign Application Priority Data

Jan. 2, 2000 (TW) ..... 89201788

(51) Int. Cl.[7] ..... A43B 7/06

(52) U.S. Cl. ..... 35/3 B; 36/3 R; 36/35 B; 36/29

(58) Field of Search ..... 36/3 B, 3 A, 3 R, 36/29, 35 B, 25 R, 28; 137/852, 855, 859

(56) References Cited

U.S. PATENT DOCUMENTS 4,602,441 * 7/1986 El Sakkaf ..... 36/3 R
5,138,775 * 8/1992 Chu ..... 36/3 B
5,477,626 * 12/1995 Kwon ..... 36/3 B
5,515,622 * 5/1996 Lee ..... 36/3 R
5,564,201 * 10/1996 O'Connell ..... 36/3 R
5,826,349 * 10/1998 Goss ..... 36/3 B
5,950,332 * 9/1999 Lain ..... 36/3 B
5,974,694 * 11/1999 Vecchiola ..... 36/3 B

* cited by examiner

*Primary Examiner*—Paul T. Sewell
*Assistant Examiner*—Jila Mohandesi
(74) *Attorney, Agent, or Firm*—Nath&Associates PLLC; Harold L. Novick

(57) ABSTRACT

A shoe with air valve for air refreshing system which includes an air inlet valve and an air outlet valves. The sole has a lateral wall that defines an air chamber and air channels in an inner portion of the sole, and there is an isolating wall separating the air chamber and air channels. The lateral wall has a through hole or bore therethrough and the isolating wall has an angled through hole or bore therethrough. The air valve has a mounting portion with a movable diaphragm and the air valve can be inserted in the lateral wall bore of the air chamber in the sole so as to provide a unidirectional air inlet valve. The unidirectional air valve can also be installed in the bore in the isolating wall. The upper portion of the through hole is formed with an expanding portion and a diaphragm is placed in the expanding portion. Thus, an air outlet valve is formed. By the aforesaid structure, the unidirectional air inlet and outlet valves are easily provided for the sole of a shoe having an air refreshing system, and thus the manufacturing cost can be reduced.

6 Claims, 3 Drawing Sheets

SHOE WITH AIR VALVE FOR AIR REFRESHING SYSTEM

FIELD OF THE INVENTION

The present invention relates in general to an air refreshing system for a shoe, and in particular relates to the combination of valves that are used as an air inlet valve and/or an air outlet valve and the sole of a shoe having an air refreshing system.

BACKGROUND OF THE INVENTION

In general, for shoes with an air refreshing system, check valves or unidirectional air inlet and outlet valves are installed at the heel of the shoes. For example, there is disclosed in U.S. Pat. No. 5,138,775, incorporated herein by reference, a unidirectional air valve located in a wall defining an air chamber in a heel of a shoe. The air chamber is compressed or is resiliently restored to the original state from a compressed state by normal walking. Thus, the air in the air chamber can be pushed to the shoe or the air out of a shoe can be absorbed into the shoe through the air inlet valve.

In the prior art air valves, a removable diaphragm is located in a longitudinal slot located on or in a lateral side of a transverse air hole. By using the diaphragm, the air valve can then be converted into a check valve, sometimes referred to as a unidirectional valve or device.

However, since the transverse air hole and longitudinal slot of the air valve are integrally formed at the periphery of the air chamber at sole, the mold for the air hole and slot is very complex and thus bears a high cost.

SUMMARY OF THE INVENTION

Accordingly, the primary object of the present invention is to provide the combination of an air valve and the sole of a shoe that is part of a shoe air refreshing system. Such air valves are unidirectional valves, often called check valves, and are used as air inlet and outlet check valves. The check valve has an insertable component that can be inserted into a passageway to convert the air flow through the passageway to unidirectional. A mounting portion with a movable diaphragm is inserted in the lateral wall of the air chamber in a sole so as to form with the air inlet valve. A through hole with a tilted angle is installed at an isolating portion between the air chamber in the sole and the air channel. At an upper portion of the through hole, it is formed with an expanding portion, and a diaphragm is placed in the expanding portion. Thus, an air outlet valve is formed. An inlet valve system includes an appropriately located passageway in the sole of the shoe to admit outside air into an air chamber located inside the shoe sole. Removeably mountable in or on the passageway is a complete valve that includes a housing having a bore therethrough, a smaller housing section adapted to be received in a bore, through hole or passageway, and a larger section having a slot therein adjacent the entrance of the valve bore, and a removeably insertable valve diaphragm. In a particular embodiment of the invention, the housing sections are cylindrical and the valve diaphragm is a solid disk that has dimensions such that it can be received in the slot.

By the aforesaid structure, the unidirectional air inlet valve and air outlet valve is formed on the sole easily and thus, the manufacturing cost is reduced.

The various objects and advantages of the present invention will be more readily understood from the following detailed description when reading in conjunction with the appended drawing.

DETAILED DESCRIPTION OF THE PREFERRED EMBODIMENTS

The details of the present invention will be described in the following with references to the appended figures in which like numerals represent like elements throughout the several views. In particular with reference to FIG. 1, there is shown a sole A of a conventional shoe having an air refresher system. Sole A is molded entirely of a conventional resilient rubbery material and has an isolating portion or transverse wall A1 that divides and isolates an air chamber S1 from an air chamber forming the remainder of the sole and designated by S2. A pad B has a corresponding planar shape to sole A and covers the entire surface area of sole A and is adhered thereto with a conventional adhesive. Thus, air chamber S1 and air chamber S2 are formed as an independent and tightly sealed spaces. A plurality of vent holes B1 are located in pad B to provide an outlet of the air from chamber S2 into the body of the shoe (not shown).

A unidirectional air outlet valve 1 and a unidirectional air inlet valve 2 are respectively installed at a location in lateral wall A1 separating air chamber S1 from air chamber S2 and at a location in a peripheral wall of air chamber S1. Through these valves, as the air chamber S1 at heel is compressed simply by a user walking and pressing the shoe heal against a floor surface the air in air chamber S1 is pushed into air chamber S2 and towards the inner part of the shoe through a passageway 11 in lateral wall A1. Air inlet valve 2 is closed. Soon afterwards, as the user picks up the heel and presses the front part of the sole onto the a floor surface air outlet valve 1 closes and the air is forced out vent holes B1. Also, environmental air located outside the shoe is drawn into air chamber S1 through air inlet valve 2 as the resilient heel is restored from a compressed state by the user lifting the heel off the floor.

Figure 3:
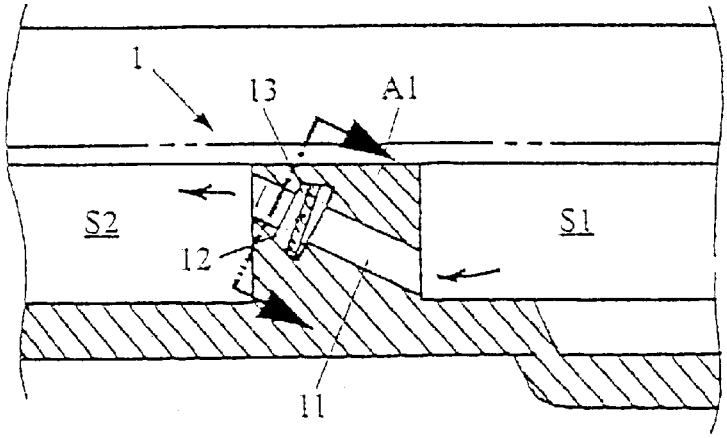
FIG. 3 is a cross sectional view of a sole of a conventional shoe with air refresher in which a valve according to the present invention has been installed in a passageway between an air inlet chamber and an air distribution chamber in which the valve diaphragm has been removed.
Figure 3A:
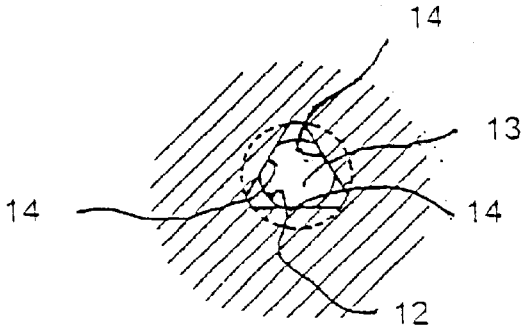
FIG. 3A is an end elevational view taken along lines 3A—3A of FIG. 3.

As shown in FIG. 3, through the structure of the air outlet valve 1 of the isolating portion A1, the thick solid portion of the isolating portion A1 is installed in a through hole 11. The through hole 11 is tilted from the bottom of the air chamber S1 towards the upper portion of the air chamber S2. A tapered expanding portion 12, having a diameter larger than that of the through hole 11, is formed near the upper section of the through hole 11 and the lower portion provides three resilient retaining segments 14. A resilient diaphragm 13, for blocking or shielding through hole 13, is located in the expanding portion 12. Diaphragm 13 is a separate, removable disk which can, for example, be molded from the same material as sole A. In FIG. 3, diaphragm 13 is shown in the open position, forced there by the flow of air indicated by the arrows. When the air flow pressure in chamber S2 is greater than the pressure in chamber S1, diaphragm 13 is seated against the opening of passageway 11, thereby acting as a check valve and preventing reverse flow of air.

According to the structure of the air outlet valve 1, as the air within the air chamber S1 is compressed, the air pressure will push the diaphragm 13 of the air outlet valve 1 to open. Thus, the air can flow into the shoe through vent B1, as shown in FIG. 3.

On the contrary, air chamber S1 is restored to the original state from aforesaid compressed state, since the air chamber S1 is negative pressured. Therefore, the aforesaid opened diaphragm 13 is pushed reversibly again so as to shield the through hole 11, namely, the air outlet valve 1 is closed.

If the opening extent of diaphragm 13 is too large, it is a possibility that diaphragm 13 can not be restored and thus the air outlet valve 1 will lose the function of communication in one way. Therefore, the aforesaid trough hole 11 is tilted and the expanding portion 12 becomes taper shaped. Therefore, the opened diaphragm 13 is only moved slightly due to the confinement from the peripheral wall of the expanding portions and the weight itself.

Figure 1:
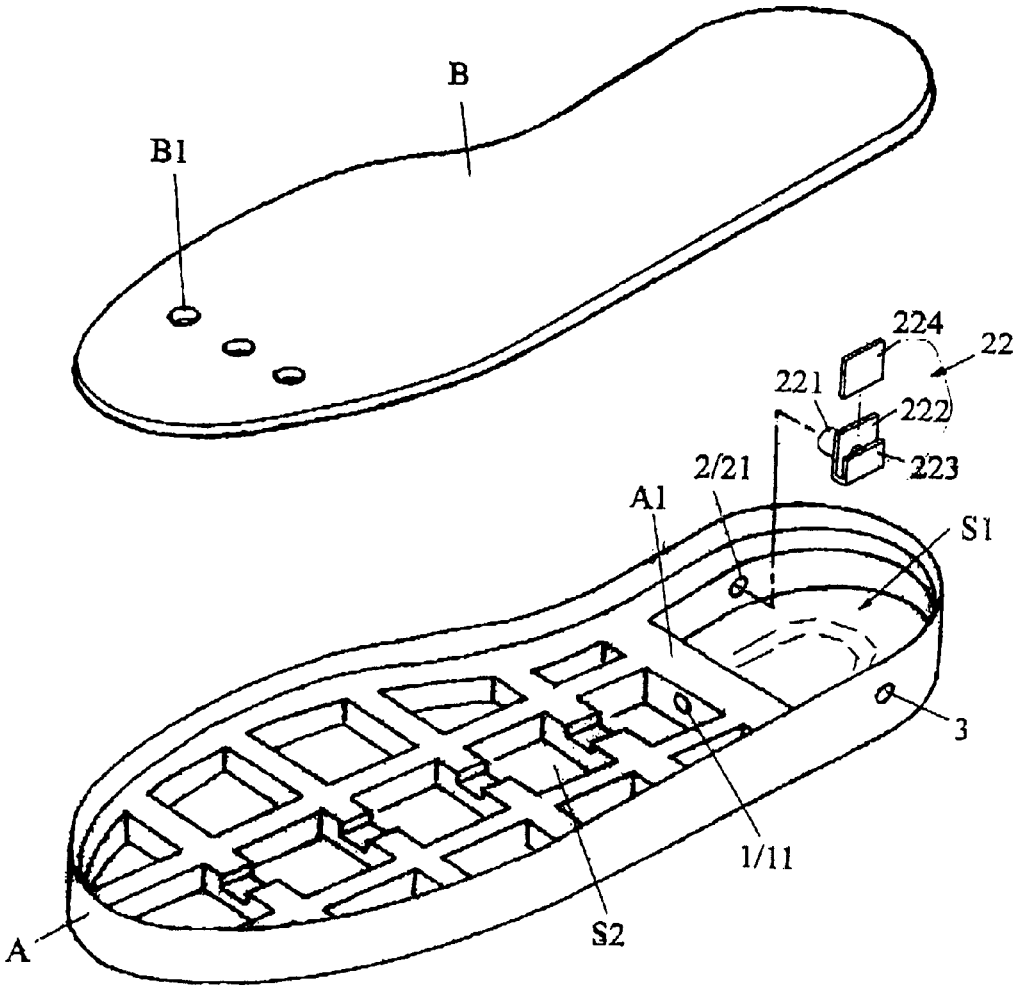
FIG. 1 is an exploded schematic perspective view of a conventional sole and cover of part of a shoe having a first embodiment of a valve in accordance with the present invention installed in an air inlet port or passageway.
Figure 4:
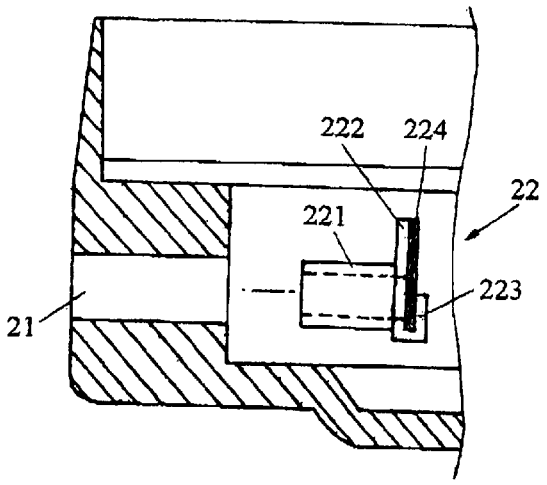
FIG. 4 is a schematic view in cross-section depicting the assembly of a valve according to the present invention being installed in the bore of a conventional shoe with air refresher.
Figure 5:
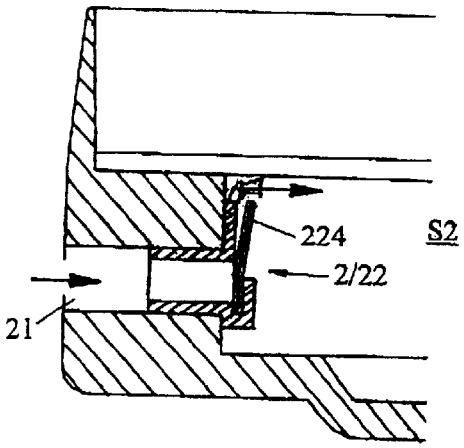
FIG. 5 is a schematic view in cross-section depicting the assembled valve in which the diaphragm has been pushed away.

With reference to FIGS. 1 and 4, the aforesaid air inlet valve 2 comprises of a transverse mounting hole 21. It is formed on the lateral wall of the air chamber S1 at sole and on a mounting portion 22, which is a separable element, as shown in FIGS. 1 and 4.

The mounting portion 22 contains an engaging tube 221 capable of being engaged into the mounting hole 21. One end portion of mounting tube 221 has a body 222 as a flat plate. The front side of body 222 is installed with a supporting portion 223. The supporting portion 223 and the body 222 are formed as U shaped. A diaphragm 224 is inserted in the gap between the supporting portion 223 and the body 222.

By the engaging tube 221 of the mounting portion 22, the mounting portion 22 can be mounted in the mounting hole 21 of sole 22, being positioned, so as to be formed as an unidirectional air inlet valve 2. Air chamber S1 at the heel is restored to the original state from the compressed state so that it becomes negatively pressured. The air pressure will push the diaphragm (224) to open so that the outer air can flow into the air chamber S1 from the engaging tube 221.

Figure 2C:
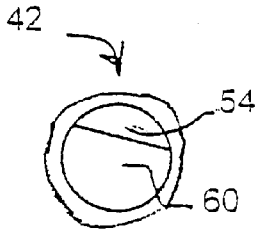
FIG. 2C is an end elevational view taken along lines 2A—2A of FIG. 2.
Figure 2A:
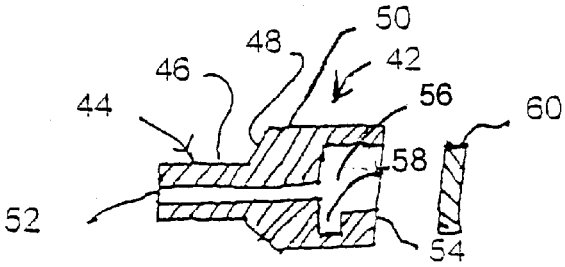
FIG. 2A is an enlarged, exploded cross-sectional view of an air inlet valve according to a second embodiment of the present invention.
Figure 2B:
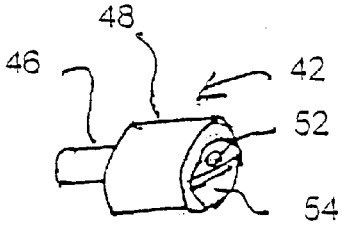
FIG. 2B is a perspective view of the air inlet valve according to the embodiment depicted in FIG. 2A.

With reference to FIGS. 2A, 2B and 2C, a second embodiment of an air inlet valve 42 is depicted. Valve 42 is comprised of a molded, rubbery, resilient, generally cylindrical housing 44 having a first, smaller diameter cylindrical section 46, a second intermediate, transition conical section 48, and a third larger, cylindrical section 50. Thus, smaller diameter cylindrical section 46 is located at one end of valve 42 and larger diameter cylindrical section 50 is located at the other end.

Housing 44 can be molded from the same material as sole A. A through hole or bore 52 extends the entire length of housing 44. At the larger end of housing 44 is an arcuate segment stopping plate 54. Thus an enlarged, chamber 56 is formed in third section 50 and together with plate 54 provides a slot 58. A diaphragm 60 is insertable into slot 58.

Valve 42 is molded separately from sole A and smaller cylindrical portion 46 is inserted into mounting hole 21 from the inside, and conical section 48 forms a seal with the wall that defines mounting hole 21. Thus, a valve according the second embodiment of the present invention can be inexpensively made, and can be very simply and quickly installed. If desired, valve 42 can be more securely retained in mounting hole 21 with an appropriate adhesive.

Figure 6:
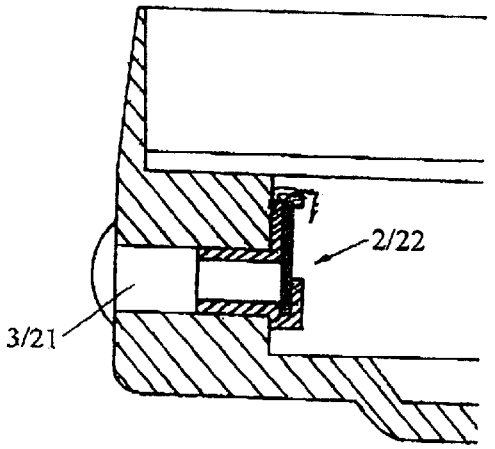
FIG. 6 is a schematic view in cross-section showing an air valve according to the present invention installed in an air inlet passageway on the inner side thereof and an air stop installed in the air inlet passageway on the outer side thereof.

In the present invention, the shoes provide a function of air exchange and are specially used in summer. While in winter, to avoid having the shoe losing the function of retaining a predetermined temperature, due to the coldness and wetness, the present invention applies a Stop 3 which can be selectively used for closing the air inlet valve, as shown in FIG. 6.

If Stop 3 is not used, it can be carried in its proper place of sole A, as shown in FIG. 1

Although the present invention has been described with reference to the preferred embodiments, it is understood that the invention is not limited to the details described thereof. Various substitutions and modifications have been suggested in the foregoing description, and others will occur to those of ordinary skills in the art. Therefore, all such substitutions and modifications are intended to be embraced within the scope of the invention as defined in the appended claims.

What is claimed is:

1. In combination, a sole for a shoe that has an air refreshing system and a unidirectional air inlet valve and an unidirectional air outlet valve in the air refreshing system, the shoe sole comprising an air outlet chamber;

an air inlet chamber defined by a peripheral wall, a through hole in said peripheral wall, and a transverse wall, said peripheral wall and transverse wall forming said wall enclosed air inlet chamber, said transverse wall having a through hole therethrough that is tilted from the bottom where said transverse wall through hole communicates with said air inlet chamber to the other end thereof where said transverse wall through hole communicates with said air outlet chamber;

said air outlet valve comprising:

an insertable first diaphragm;

a tapered expanding portion located in the through hole, said first diaphragm located in the expanding portion and shielding the through hole; and the air inlet valve comprising:

an insertable second diaphragm;

a valve housing having a mounting portion which is capable of being inserted in said peripheral wall through hole and a valve section having a slot, said second diaphragm being insertable in said slot.

2. The combination as claimed in claim 1, wherein a tapered expanding portion is formed at an upper portion of the through hole of the air valve.

3. The combination as claimed in claim 1, includes a stop, which can be selectively inserted into the air inlet valve.

4. The combination as claimed in claim 1, wherein said inlet valve comprises a front side of the body is installed with a supporting portion, the supporting portion and the body are formed as U shaped, and a diaphragm is inserted between the supporting portion and the body.

5. The combination as claimed in claim 1, wherein said inlet valve comprises a housing having a first portion that can be inserted in said peripheral wall through hole and an integral second portion that has a larger cross-section, and a slot in said second portion, said diaphragm being insertable in said slot.

6. The combination as claimed in claim 5 wherein said sole is molded of a rubbery material and said inlet valve housing and said second diaphragm are molded of the same rubbery material as said sole.

* * * * *